US009445703B2

(12) United States Patent
Heidel et al.

(10) Patent No.: US 9,445,703 B2
(45) Date of Patent: Sep. 20, 2016

(54) DISHWASHER WITH FAULT IDENTIFICATION

(75) Inventors: Andreas Heidel, Holzheim (DE); Reinhard Hering, Holzheim (DE); Bernd Kränzle, Finningen (DE)

(73) Assignee: BSH Hausgeräte GmbH, Munich (DE)

( * ) Notice: Subject to any disclaimer, the term of this patent is extended or adjusted under 35 U.S.C. 154(b) by 983 days.

(21) Appl. No.: 13/639,196

(22) PCT Filed: Mar. 21, 2011

(86) PCT No.: PCT/EP2011/054182

§ 371 (c)(1),
(2), (4) Date: Oct. 4, 2012

(87) PCT Pub. No.: WO2011/128176

PCT Pub. Date: Oct. 20, 2011

(65) Prior Publication Data

US 2013/0048025 A1 Feb. 28, 2013

(30) Foreign Application Priority Data

Apr. 14, 2010 (DE) ..... 10 2010 027 756

(51) Int. Cl.
*A47L 15/46* (2006.01)
*A47L 15/00* (2006.01)
*A47L 15/42* (2006.01)

(52) U.S. Cl.
CPC ..... *A47L 15/0049* (2013.01); *A47L 15/4217* (2013.01); *A47L 2401/06* (2013.01);
(Continued)

(58) Field of Classification Search
CPC ..... A47L 2401/08; A47L 2501/01; A47L 15/4225; A47L 15/0049; A47L 15/0023
USPC ..... 134/18, 56 D, 57 D, 25.2, 58 D, 113, 134/57 R; 68/12.02, 12.05, 12.19; 417/26, 417/36
See application file for complete search history.

(56) References Cited

U.S. PATENT DOCUMENTS

2007/0151579 A1* 7/2007 Hooker ..... A47L 15/0023 134/18
2007/0163626 A1* 7/2007 Klein ..... A47L 15/0049 134/56 D
2011/0038736 A1 2/2011 Hesterberg et al.

FOREIGN PATENT DOCUMENTS

CN 1883361 A 12/2006
CN 1883363 A 12/2006
(Continued)

OTHER PUBLICATIONS

Report of Examination including National Search Report CN 20118001664 dated Apr. 1, 2014.
(Continued)

*Primary Examiner* — David Cormier
*Assistant Examiner* — Thomas Bucci
(74) *Attorney, Agent, or Firm* — Michael Tschupp; Andre Pallapies

(57) ABSTRACT

A dishwasher includes a control facility for executing a wash cycle for cleaning items held in a wash chamber which is filled with water via a water inlet facility having an inlet valve operably connected to the control facility. To identify malfunction of the water inlet facility, the control facility executes an identification sequence which includes a test filling phase, in which the inlet valve is opened for a period corresponding to a predefined time value. A detection facility detects during operation of a recirculation pump to recirculate water in the wash chamber at least one operating parameter corresponding to a quantity of water in the wash chamber at an end of the test filling phase. The control facility determines a water flow into the wash chamber during the test filling phase from the detected operating parameter and compares the determined water flow with a minimum water flow.

25 Claims, 3 Drawing Sheets

(52) U.S. Cl.
CPC ..... *A47L2401/08* (2013.01); *A47L 2501/04* (2013.01); *A47L 2501/05* (2013.01); *A47L 2501/26* (2013.01)

(56) References Cited

FOREIGN PATENT DOCUMENTS

| | | | | | |
|---|---|---|---|---|---|
| DE | 102004050396 | A1 | | 4/2006 | |
| DE | WO 2009132936 | A1 | * | 11/2009 | ..... A47L 15/0023 |
| EP | 0326893 | A2 | | 8/1989 | |
| WO | 2006033027 | A1 | | 3/2006 | |
| WO | WO 2009132936 | A1 | * | 11/2009 | ..... A47L 15/0023 |
| WO | WO 2009143220 | A1 | * | 11/2009 | ..... A47L 15/0049 |
| WO | 2011015506 | A2 | | 2/2011 | |

OTHER PUBLICATIONS

International Search Report PCT/EP2011/054182.

* cited by examiner

DISHWASHER WITH FAULT IDENTIFICATION

BACKGROUND OF THE INVENTION

The present invention relates to a dishwasher, in particular a household dishwasher, having a control facility for carrying out at least one wash cycle for cleaning items being washed, having a wash chamber to hold the items being washed during the wash cycle, having a water inlet facility, which can be connected to an external water supply facility for the purpose of filling the wash chamber with water, the water inlet facility having an inlet valve which can be opened and closed by the control facility, and having a recirculation pump, which can be set, in particular controlled or regulated, by the control facility, for recirculating the water present in the wash chamber.

BRIEF SUMMARY OF THE INVENTION

The object of the present invention is to provide a dishwasher, in particular a household dishwasher, in which the filling of the wash chamber with water is improved.

The object is achieved with a dishwasher of the type mentioned in the introduction in that the control facility is configured to carry out an identification sequence to identify a malfunction of the water inlet facility, said identification sequence comprising a test filling phase, in which the inlet valve is opened for a period which corresponds to a predefined time value, with at least one detection of at least one operating parameter of the running recirculation pump corresponding to the quantity of water present in the wash chamber being performed at the end of the test filling phase by means of a detection facility and with the control facility being configured to determine a water flow into the wash chamber during the test filling phase from the detected operating parameter and to compare the determined water flow with an intended minimum water flow.

The control facility of the dishwasher is configured to act on actuators of the dishwasher in a controlling and/or regulating manner, thereby allowing wash processes, also referred to as wash cycles or wash runs, in which the items being washed can be cleaned using water, to be carried out automatically. To this end the control facility can be configured as a so-called sequence controller, in particular as an electronic sequence controller.

Stored in the control facility is at least one wash program for carrying out or controlling a wash cycle. A number of wash programs can also be provided, one of which can be selected and started by the operator in each instance. This allows the sequence of a wash cycle to be tailored in particular to the load quantity, the type of load, the degree of soiling of the items being washed and/or the desired duration of the wash cycle.

The stored wash programs can preferably be configured so that the wash cycle controlled by them in each instance comprises in particular at least one prewash cycle for precleaning items being washed, at least one cleaning cycle for the thorough cleaning of items being washed, in particular with the aid of one or more cleaning agents, at least one intermediate rinse cycle for the removal of soiled water and/or water containing cleaning agents from the items being washed, at least one final rinse cycle for preventing spots on the washed items and/or for preparation for a drying step and/or at least one drying cycle for drying the items being washed. The prewash cycle, cleaning cycle, intermediate rinse cycle and final rinse cycle are referred to as water-conducting wash sub-cycles, since the items being cleaned are treated with water as they are performed. Provision is not generally made for the use of water during the drying cycle.

The treatment of the items being washed with water takes place here in an essentially closed wash chamber of the dishwasher, in particular in a wash container, which has a loading opening that can be closed off by a door.

A water inlet facility is assigned to the wash chamber, being configured so that it can be connected to an external water supply facility, in particular to a water supply facility installed in the building, so that the water required to carry out wash cycles can be drawn and introduced into the wash chamber. To this end the water inlet facility can be connected for example to a faucet or a so-called corner valve of the external water supply facility. The water entering the wash chamber by way of the water inlet facility is also referred to as inlet water. The water inlet facility here has an inlet valve, which can be opened and closed by the control facility so that the drawing of water can be performed automatically. The inlet valve can in particular be a solenoid valve, which can only be moved to an open position and a closed position, thereby simplifying the structure of the dishwasher.

Also assigned to the wash chamber is a recirculation pump for recirculating the introduced water, allowing the water present in the wash chamber to be taken for example from a water collection facility and applied to the items being washed by way of a spray system assigned to the wash chamber. The recirculation pump here can be controlled and/or regulated by the control facility of the dishwasher. In this process the water recirculated in the wash chamber can, depending on the operating phase of the dishwasher, contain cleaning agents, cleaning aids, for example rinse aid, and/or dirt, which has been detached from the items being washed, and is also referred to as washing water, washing liquor or washing fluid.

The control facility of the dishwasher is configured so that at least one identification sequence can be carried out, preferably automatically, to identify a malfunction of the water inlet facility. A malfunction here refers to a fault, whereby it is no longer ensured that the wash chamber is filled with the intended setpoint quantity of water. The identification sequence here comprises a test filling phase, during which the inlet valve is opened by the control facility subject to time control, the opening period corresponding to a predefined time value. The predefined time value can be stored in the control facility or can be set by the control facility according to a stored algorithm. At the end of the test inlet sequence a detection facility, in particular a sensor, detects, in particular measures, at least one operating parameter of the recirculation pump, which is activated at least during the detection, in particular measurement, corresponding to the quantity of water present in the wash chamber. The detection facility is connected to the control facility or integrated or implemented in said control facility in such a manner that the result of the detection, which represents the quantity of water present in the wash chamber, can be processed by the control facility. The control facility here is configured so that the water flow entering the wash chamber during the test filling phase can be determined taking into account the detection result. The water volume flow or the water throughput through the water inlet facility of the dishwasher here is a measure of the quantity of water flowing into the wash chamber per unit of time. If it can be assumed that at the start of the test inlet phase the wash container is essentially free of water, the water flow prevailing during the test inlet phase can be determined particularly simply, by dividing the quantity of water measured at the end of the test inlet phase by the predefined time value for the period for which the inlet valve is open.

The water flow thus determined is then compared by the control facility with an intended minimum water flow. If the determined water flow is below the minimum water flow, it can be concluded that there is a malfunction of the water inlet facility. The value of the minimum water flow can be defined beforehand and stored as a fixed value in the control facility or can be set by the control facility as a function of the situation, e.g. as a function of a selected wash program. The value of the minimum water flow can be set so that when it is reached, the functional capability of the dishwasher is still ensured. Appropriate tests can be carried out to this end.

With the proposed dishwasher, it is possible to identify malfunctions of the water inlet facility regardless of whether the cause lies in the area of the water supply facility external to the appliance, in particular the building water supply line, or in the dishwasher itself. Thus a faulty inlet flow can be identified, which is due to a connection between the dishwasher and an external water supply facility which is unsuitable for said purpose, for example because its pressure is too low. Similarly a faulty water inlet can be identified which is due to a malfunction of components of the external water supply facility. Thus for example it is possible to identify malfunctions due to dirty and/or calcified lines, pumps, faucets or corner valves or perhaps due to closed faucets or corner valves. Equally a malfunction can be identified which is due to a faulty component of the dishwasher itself, for example a damaged and/or blocked inlet valve or a kinked connecting hose.

One significant advantage of the inventive dishwasher is its simplicity. It is thus possible, by indirectly determining the quantity of inlet water introduced during the test inlet phase and by knowing the period for which the inlet valve is open during the test inlet phase, to dispense with direct measurement of the water flow. For example it is possible to dispense with the impeller meter that is frequently used in the area of the water inlet facility in conventional dishwashers without adversely affecting the identification of malfunctions of the water inlet facility.

According to an advantageous development of the invention provision is made for the outputting of a message which signals the identification of a malfunction to a user. This allows the user to respond promptly to the malfunction, in particular allowing said user to eliminate simpler faults such as closed faucets or the like him/herself. In other instances the user can generally determine for him/herself whether the cause of the malfunction lies in the area of the external water supply facility or in the area of the dishwasher itself. It is thus possible specifically to request maintenance personnel who are competent for the respective area. Generally it is thus possible to prevent maintenance personnel being requested unnecessarily or maintenance personnel with the wrong competencies being requested.

According to an expedient development of the invention the message is output by way of an output facility, which can comprise acoustic and/or optical output means. Optical output means can comprise lamps, light-emitting diodes, alphanumeric and/or graphic output means. Acoustic output means can feature for example buzzers and/or loudspeakers.

According to an advantageous development of the invention provision is made in particular for automatic deactivation of the recirculation pump when a malfunction is identified. This reliably prevents damage to the recirculation pump due to it running dry.

According to an expedient development of the invention the identification sequence can be carried out automatically during the wash cycle, preferably at its start. This ensures that the function of the water inlet facility is checked every time a wash cycle is carried out. This allows faults to be identified promptly, which only become evident after some time during use of the dishwasher.

According to an advantageous development of the invention the test filling phase is preferably integrated in a filling phase of the wash cycle to draw a predefined quantity of water. During the course of a wash cycle it is generally necessary to draw a predefined quantity of water several times. Integrating the test inlet phase in such a filling phase means that the water drawn during the test inlet phase can form part of the overall quantity to be drawn during the filling phase. This allows the water consumption of a dishwasher with a test inlet phase to be kept at the level of a dishwasher without a test inlet phase.

According to an expedient development of the invention provision is made for an automatic termination of the wash cycle when a malfunction is identified. This prevents a wash cycle being performed with inadequate quantities of water during its individual phases. This allows an unsatisfactory washing and/or drying result to be avoided as well as damage to the dishwasher, for example due to a heating facility in the dishwasher overheating.

According to an advantageous development of the invention provision can be made before the test filling phase for a discharge phase, in which a drain pump is used to discharge the water present in the wash chamber. This ensures that at the start of the test inlet phase there is no water or at most a negligible quantity of water present in the wash chamber. It is then possible to determine the water flow simply but still reliably, by dividing the quantity of water detected, in particular measured, at the end of the test inlet phase by the predefined time value for the period for which the inlet valve is open. It is thus possible in particular to avoid inaccuracies due to a previous discharge process not being completed or the user putting items to be washed that are filled with fluid in the wash chamber.

According to an expedient development of the invention at the start of the test filling phase the detection facility, in particular a sensor, carries out at least one additional detection, in particular measurement, of the operating parameter of the running recirculation pump corresponding to the quantity of water present in the wash chamber. This allows the quantity of water introduced during the test inlet phase to be determined reliably regardless of any quantity of inlet water present at the start of the test inlet phase. This in turn allows the water flow that is actually of interest to be detected particularly accurately.

According to an advantageous development of the invention the operating parameter preferably represents the electrical power consumption of the recirculation pump. The pumps of dishwashers are generally driven by electric motors, for example brushless direct current motors (BLDC motors). The power consumption of the respective recirculation pump correlates directly with the quantity of water present in the wash chamber so that it is thus possible to determine the quantity of water in a reliable manner. Also the electrical power can be detected relatively easily, for example by means of a current measurement. In many instances a sensor is assigned anyway to the recirculation pump of a dishwasher, to detect its power consumption, for example in order to be able to set the output, so that fault identification can take place largely using components that are present anyway. In many instances it is only necessary to modify the control facility itself, for example by means of a software adjustment.

The invention also relates to a method for identifying a malfunction in a dishwasher, which has a control facility for carrying out at least one wash cycle for cleaning items being washed, a wash chamber to hold the items being washed during the wash cycle, a water inlet facility, which can be connected to an external water supply facility for the purpose of filling the wash chamber with water, the water inlet facility having an inlet valve which can be opened and closed by the control facility, and a recirculation pump, which can be set, in particular controlled or regulated, by the control facility, for recirculating the water present in the wash chamber. In this process the control facility carries out at least one identification sequence or at least one identification process to identify a malfunction of the water inlet facility, said identification sequence comprising a test filling phase, in which the inlet valve is opened for a period which corresponds to a predefined time value, with detection, in particular measurement by means of a sensor, of an operating parameter of the running recirculation pump corresponding to the quantity of water present in the wash chamber being performed at the end of the test filling phase by means of a detection facility and with a water flow into the wash chamber during the test filling phase being determined by means of the control facility from the detected, in particular measured, operating parameter and being compared with an intended minimum water flow.

The inventive method allows simple, fast and reliable identification of malfunctions of the water inlet facility and is characterized by minor requirements in respect of the structural embodiment of the dishwasher.

Other advantageous embodiments and/or developments of the invention are set out in the subclaims.

The advantageous developments of the invention set out in the dependent claims and/or explained above can be provided individually or in any combination with one another.

BRIEF DESCRIPTION OF THE DRAWINGS

The invention and its developments and their advantages are described in more detail below with reference to figures, in which.

DETAILED DESCRIPTION OF EXEMPLARY EMBODIMENTS OF THE PRESENT INVENTION

Figure 1:
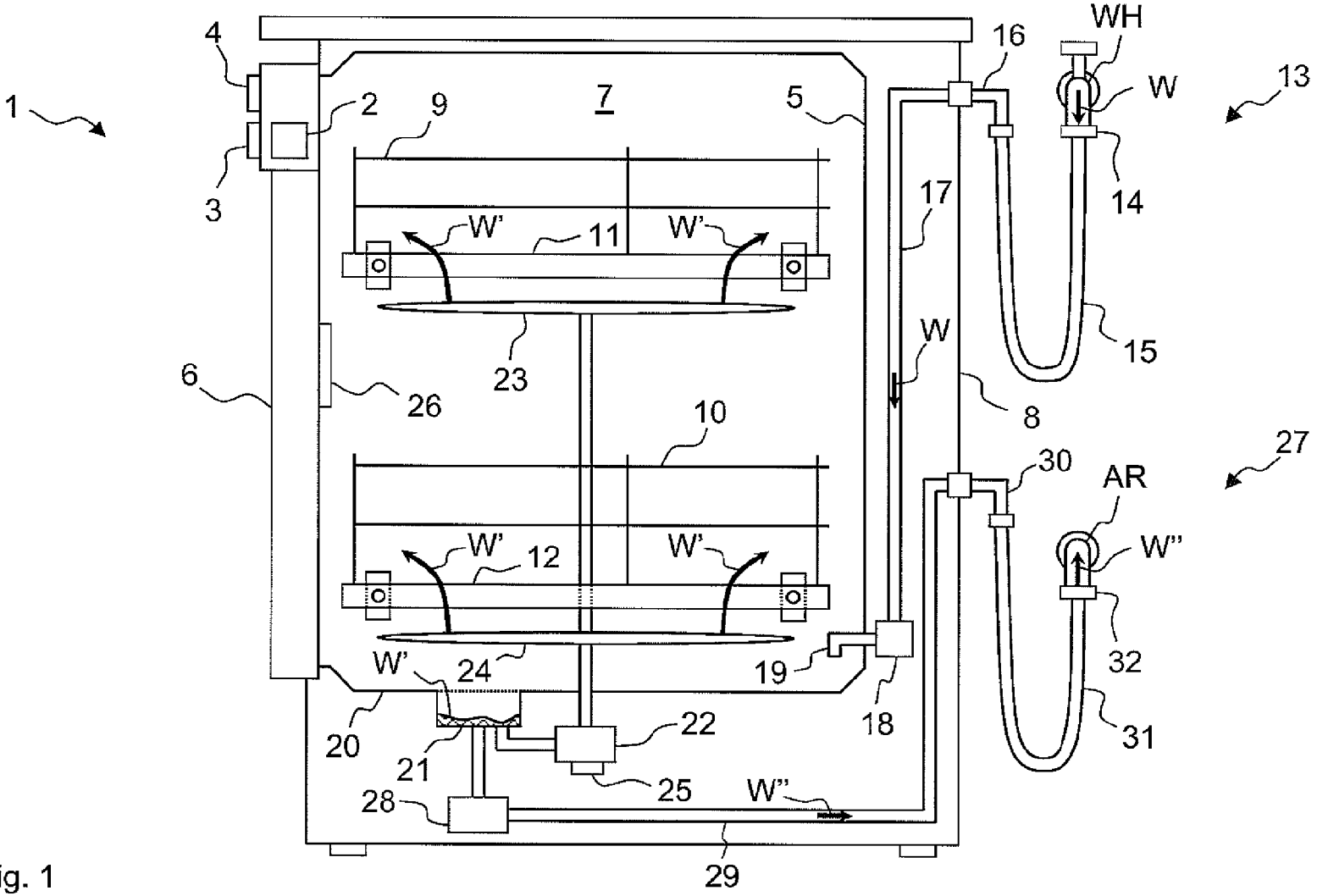
FIG. 1 shows a schematic side view of an advantageous exemplary embodiment of an inventive household dishwasher.

In the figures which follow corresponding parts are shown with the same reference characters.

Only the components of a dishwasher that are necessary for an understanding of the invention are provided with reference characters and explained. It goes without saying that the inventive dishwasher can comprise further parts and modules.

FIG. 1 shows a schematic side view of an advantageous exemplary embodiment of an inventive household dishwasher 1. The dishwasher 1 has a control facility 2, in which at least one wash program for controlling a wash cycle for washing items to be washed, in particular tableware, is stored. A number of wash programs are expediently stored, so that the sequence of a wash cycle controlled by the control facility 2 can be tailored for example to the load quantity, the type of load, the degree of soiling of the items being washed and/or the desired duration of the wash cycle to be performed in each instance by the control facility 2.

The control facility 2 is assigned an operating facility 3, which allows an operator of the dishwasher 1 to call up one of the wash programs and thereby start it. The control facility 2 is also assigned an output facility 4, which allows the outputting of messages to the operator. The output facility 4 can comprise display lamps, light-emitting diodes, an alphanumeric display and/or a graphic display for outputting optical messages. Additionally or independently hereof the output facility 4 can in some instances feature a buzzer, a loudspeaker and/or the like for outputting acoustic messages.

The dishwasher 1 further comprises a wash container 5, which can be closed off by a door 6, so that a closed wash chamber 7 results for washing items to be washed. The wash container 5 can optionally be disposed in the interior of a housing 8 of the dishwasher 1. The housing 8 is not required for integrated dishwashers and some of the top can be dispensed with completely. FIG. 1 shows the door 6 in its closed position. The door 6 can be moved to an open position by pivoting it about an axis disposed perpendicular to the plane of the drawing, in which open position it is aligned essentially horizontally, allowing the introduction and removal of items to be washed. In the exemplary embodiment illustrated in FIG. 1 the operating facility 3 is disposed in a user-friendly manner on an upper segment of the door 6. The output facility 4 is likewise disposed on the upper segment of the door 6, so that optical messages are clearly visible and/or any acoustic messages can easily be heard. The control facility 2 is also positioned there so that the necessary signal connections between the operating facility 3, the output facility 4 and the control facility 2 can be kept short. In principle however it is possible to dispose the operating facility 3, the output facility 4 and/or the control facility 2 in a different place. In particular according to one alternative variant the control facility can in some instances also be accommodated in a base module beneath the wash container. The control facility 2 could also be configured in a decentralized manner such that it comprises spatially separated components which are connected by way of communication means in such a manner that they can interact.

To position tableware the dishwasher 1 has an upper rack 9 and a lower rack 10. The upper rack 9 is disposed on pull-out rails 11, which are fastened respectively to opposing side walls of the wash container 5 extending in the depthwise direction of said wash container. When the door 6 is open, the rack 9 can be pulled out of the wash container 5 by means of the pull-out rails 11, facilitating the loading and unloading of the upper rack 9. The lower rack 10 is similarly disposed on pull-out rails 12 and can be pulled out on the door 6 in its horizontal open position.

The wash program(s) stored in the control facility can each provide a number of wash sub-cycles, for example in this sequence at least one prewash cycle, at least one cleaning cycle, at least one intermediate rinse cycle, at least one final rinse cycle and/or at least one drying cycle. The prewash cycle, cleaning cycle, intermediate rinse cycle and final rinse cycle here are referred to as water-conducting wash sub-cycles, since while they are being performed, the items being washed that are positioned in the wash chamber 7 are treated with washing water W. There is generally no provision for treating the items being washed with washing water W' during the drying cycle.

In the exemplary embodiment water W is used as washing water W' for treating the items being washed, said water W being able to be drawn from an external water supply facility WH, in particular a water line in the building, which is connected for example to a public drinking water supply network, and introduced into the wash chamber 7. At the start of every water-conducting wash sub-cycle fresh water W is typically introduced to form washing water W', which is then discharged at the end of the respective wash sub-cycle to an external waste water disposal facility AR as waste water W". However it is also possible to store washing water W' of a wash sub-cycle in a storage container (not shown) and introduce it once again into the wash chamber 7 in a later wash sub-cycle.

The dishwasher 1 in FIG. 1 comprises a water inlet facility 13, which is provided for connection to the external water supply facility WH. As in FIG. 1, the external water supply facility WH can be a faucet WH of a water installation in the building, which supplies pressurized water W. The water inlet facility 13 comprises a connector 14, which is provided for connection to the faucet WH. The connection can be made for example by way of a thread arrangement, a bayonet arrangement or the like. Provided downstream of the connector 14 is a connecting line, in this instance in particular a connecting hose 15, which is preferably configured to be flexible. The downstream end of the connecting hose 15 is connected to a connector 16 fixed to the housing.

Provided downstream of the connector 16 fixed to the housing is a supply line 17, which is connected to an input side of an inlet valve 18 that can be switched by means of the control facility 2. An output side of the inlet valve 18 is in turn connected to a water inlet 19 of the wash chamber 7. This allows water W to be conducted into the interior of the wash chamber 7 of the dishwasher 1 by means of the water inlet facility 13. The inlet valve 18 here can be configured as a switchable solenoid valve, which only has an open position and a closed position. A water processing system (not shown), for example a softening system, can be provided in the supply line 17.

Instead of or in addition to the appliance-side inlet valve 18, it is also possible to provide an external inlet valve, in particular a so-called aqua-stop valve, which can preferably be switched, in particular blocked and opened, by means of the control facility, between the connector 14 and the faucet WH or between the faucet and the input-side end of the water connection line, optionally omitting the connector 14.

The water W reaching the wash chamber 7 by way of the water inlet 19 passes into a collection facility 21, which can preferably be configured as a collection pan 21 and is configured on a base 20 of the wash container 5, due to the force of its weight. An input side of a recirculation pump 22 is connected to the collection pan 21 in a fluid-conducting manner. An output side of the recirculation pump 22 is further connected to a spray facility 23, 24, which allows washing water W' to be applied to the items to be washed that have been introduced into the wash chamber 7. In the exemplary embodiment in FIG. 1 the spray facility 23, 24 comprises an upper rotatable spray arm 23 and a lower rotatable spray arm 24. However fixed spray elements and/or other movable spray facilities could alternatively or additionally also be provided.

The washing water W' exiting from the spray facility 23, 24 when the recirculation pump 22 is activated passes back into the collection pan 21 within the wash chamber 7 due to the force of its weight. In order to be able to monitor the recirculation pump 22 as the washing water W' is recirculated, a detection facility 25, in particular a sensor, is assigned to the recirculation pump 22, said detection facility 25 detecting an operating parameter that represents the electrical power consumption of the recirculation pump 22. The operating parameter can be for example the electric current consumption of the recirculation pump 22, from which it is simple to derive the electrical power consumption.

In the conventional manner the dishwasher 1 also has a dosing facility 26, which allows cleaning agents and/or cleaning aids to be added to the washing water W' present in the wash chamber 7, to improve the cleaning action and/or drying action of a wash cycle.

The dishwasher 1 illustrated in FIG. 1 also has a drain facility 27, which serves to pump washing water W' that is no longer required out of the wash chamber 7 to the outside as waste water W". The drain facility 27 comprises a drain pump 28, the input side of which is connected to the collection pan 21. The output side of the drain pump 28 in contrast is connected to a connecting line 29, the downstream end of which is connected to a connection 30 on the dishwasher 1, which is fixed to the housing. Fastened to an output of the connection 30 fixed to the housing is a waste water line, in particular a waste water hose 31, which is preferably configured to be flexible. Also disposed on the downstream end of the waste water hose 31 is a connector 32 which is provided to connect the drain facility 27 to a waste water disposal facility AR. The waste water disposal facility AR can be a waste water pipe of a water installation in the building. The connection between the connector 32 and the waste water pipe can be configured as a screw connection, bayonet connection, plug-in connection or the like.

Figure 2:
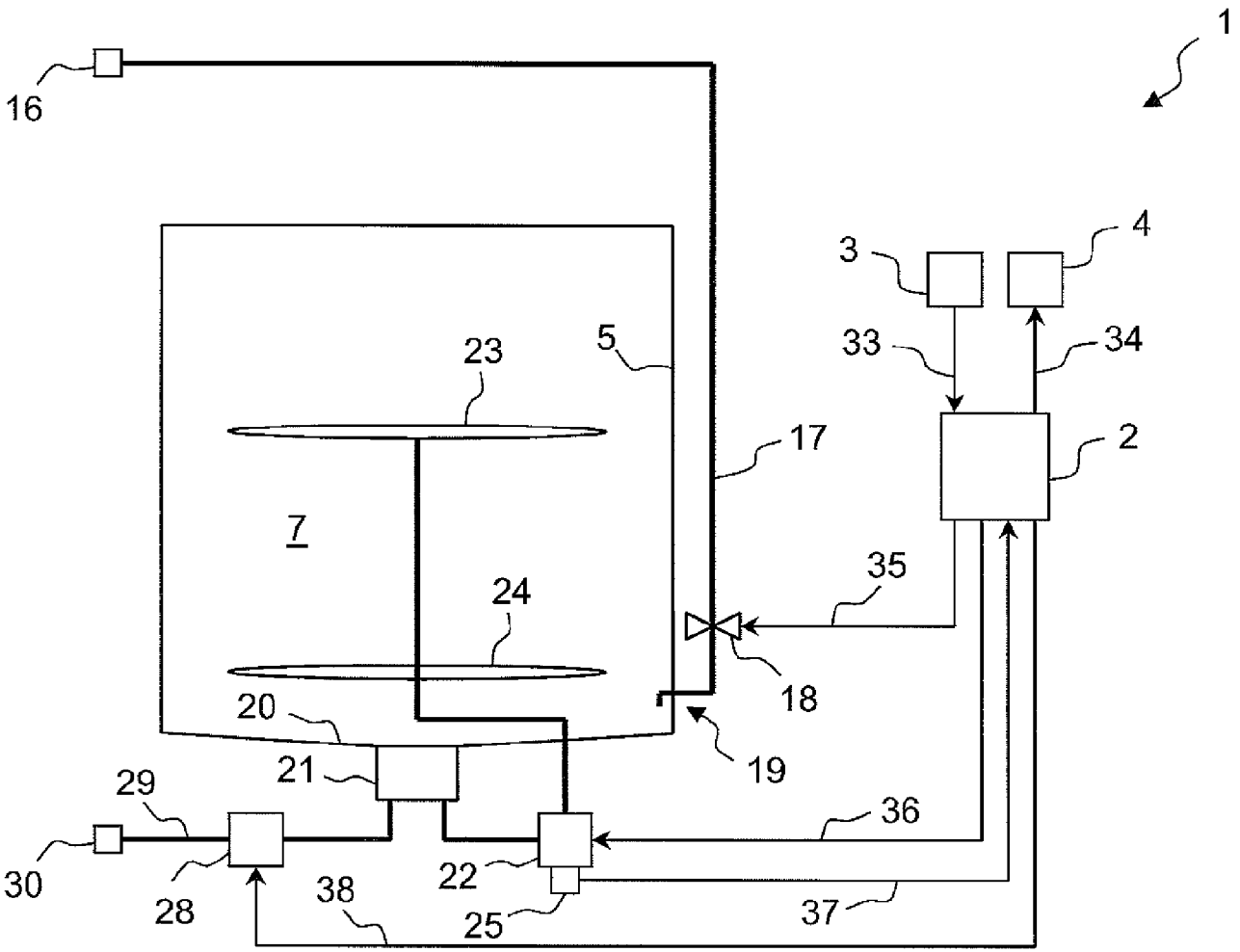
FIG. 2 shows a block diagram of the household dishwasher from FIG. 1.

FIG. 2 shows a block diagram of the household dishwasher 1 from FIG. 1, illustrating in particular the control and communication concept. In the exemplary embodiment a signal line 33 is provided, which connects the operating facility 3 to the control facility 2 in such a manner that operating commands from an operator can be transmitted from the operating facility 3 to the control facility 2. A signal line 34 is also provided, which connects the control facility 2 to the output facility 4, so that information provided by the control facility 2 can be transmitted to the output facility 4 and output there to the operator.

A control line 35 is also provided, which connects the control facility 2 to the switchable inlet valve 18 in such a manner that the inlet valve 18 can be closed and opened respectively by the control facility 2. This allows the introduction of water W into the wash chamber 7 to be controlled by the control facility 2. A further control line 36 connects the control facility 2 to the recirculation pump 22. This also allows the recirculation of washing water W' in the wash chamber 7 to be set, in particular controlled or regulated, by the control facility 2.

A signal line 37 is also provided, which connects the true running monitoring facility 25 to the control facility 2. The signal line 37 allows information generated by the detection facility 25 relating to the power consumption of the recirculation pump 22 to be transmitted to the control facility 2. A control line 38 is also provided, which connects the control facility 2 to the drain pump 28, so that the drain pump 28 can also be switched, in particular deactivated and activated, by the control facility 2.

Figure 3:
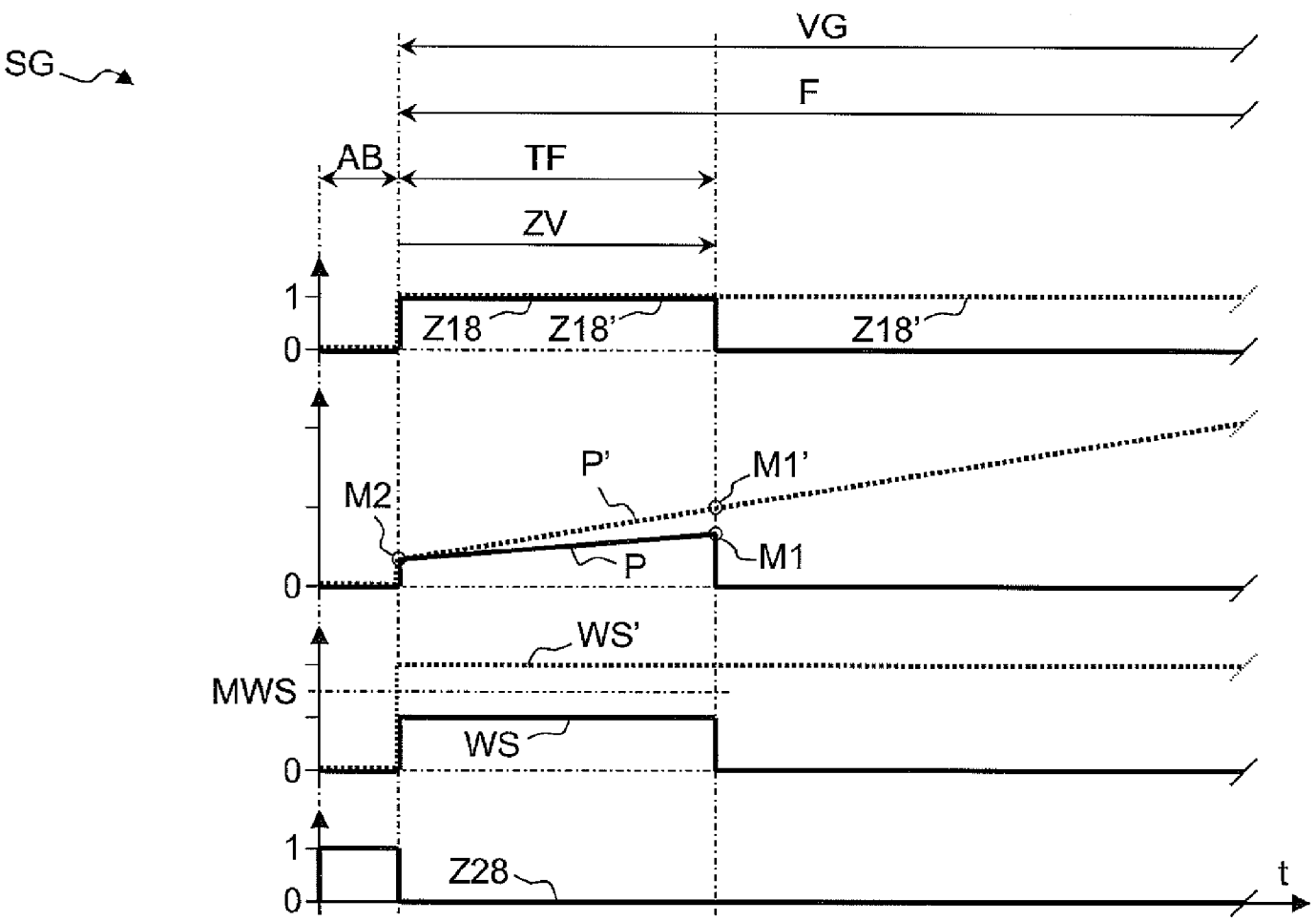
FIG. 3 shows an exemplary time sequence of an initial segment of a wash cycle for the household dishwasher in FIGS. 1 and 2.

FIG. 3 shows the performance of an exemplary identification sequence TF, AB for identifying a malfunction of the water inlet facility 13 of the dishwasher 1 in FIGS. 1 and 2, which is carried out automatically by the control facility 2 at the start of a wash cycle SG. Only an initial phase of the wash cycle SG is shown here on a time axis t. A prewash cycle VG is provided by way of example as a first water-conducting wash sub-cycle of the wash cycle SG, an initial phase thereof being illustrated. Further water-conducting wash sub-cycles can follow the prewash cycle, with a cleaning cycle, an intermediate rinse cycle and a final rinse cycle being able to be provided for example in this sequence. These can be followed by a drying cycle. It would also be conceivable however to dispense with the prewash cycle and provide a cleaning cycle as the first water-conducting wash sub-cycle.

In FIG. 3 a continuous curve Z18 shows the operating state Z18 of the inlet valve 18 when a malfunction of the water inlet facility 13 is present and a dotted curve Z18' shows the operating state Z18' of the inlet valve 18 when the water inlet facility 13 functions correctly. The inlet valve 18 here can assume an operating state "0" in which it is closed and an operating state "1" in which it is open.

A continuous curve P also shows the electrical power consumption P of the recirculation pump 22 when there is a malfunction and a dotted curve P' shows the electrical power consumption P' of the recirculation pump 22 when the water inlet facility 13 functions correctly. Also shown is a continuous curve WS, which shows the water volume flow WS that results when the water inlet facility 13 malfunctions and a dotted curve WS', which shows the water flow WS' when the water inlet facility 13 functions correctly. A curve Z28 also shows the operating state Z28 of the drain pump 28, with the operating state "0" being assumed when the drain pump 28 is deactivated and the operating state "1" being assumed when the drain pump 28 is activated.

The identification sequence TF, AB comprises a test filling phase TF, during which the inlet valve 18 is opened for a period that is a function of a predefined time value ZV, so that water W is introduced into the wash chamber 7 by way of the inlet valve 18. It is possible, from the quantity of water W drawn during the test filling phase TF and the predefined time value ZV, to determine the water flow WS resulting during the test inlet phase TF. The test inlet phase TF here is integrated in a filling phase F, which serves to cover the water W requirement of the prewash cycle VG. The water W drawn during the test filling phase TF therefore forms part of the quantity of water W for the prewash cycle VG drawn in total during the filling phase F. This means that the performance of the test inlet phase TF does not result in any increase in the water consumption of the dishwasher 1.

In FIG. 3 the inlet valve 18 is continuously open during the test filling phase TF, so that the duration of the test filling phase TF corresponds precisely to the period for which the inlet valve 18 is open. However provision could be made in the context of the test filling phase TF for a staged or step by step, in other words portioned, drawing of the water W, with the inlet valve 18 being opened and closed again a number of times, in other words being operated cyclically. However it would be essential here for the sum of the individual periods for which the inlet valve 18 is open to correspond to the predefined time valve ZV, so that the water flow WS can be determined from the drawn quantity of water W and the predefined time valve ZV here too.

The sequence of the wash cycle SG will be explained in the following when there is a malfunction. In the exemplary embodiment in FIG. 3 the recirculation pump 22 is activated at the start of the test inlet phase TF, so that the power consumption P rises from zero to a start value. As the quantity of water W introduced into the wash chamber 7 increases, the braking moment that the recirculation pump 22 has to overcome rises. This causes the electrical power consumption P, P' to rise until the end of the test inlet phase TF. At the end of the test inlet phase TF the detection facility 25, in particular a sensor, detects, in particular measures Ml, the electrical power consumption P of the recirculation pump 22, which is a measure of the quantity of water W' present at this time in the wash chamber 7. However a different operating parameter of the recirculation pump could also be measured, which correlates with said quantity of water W'.

Assuming that at the start of the test filling phase there was no water W' present in the wash chamber, the detected, in particular measured, quantity of water W' corresponds to the introduced quantity W. The control facility 2 can therefore now determine the water flow WS introduced during the test inlet phase TF by dividing the quantity of water W introduced, as determined by means of the detection, in particular measurement Ml, by the predefined time value ZV. To ensure this assumption, a discharge phase AB is provided in the exemplary embodiment, during which any water W' present in the wash chamber 7 is automatically discharged by means of the drain pump 28. The drain phase is not absolutely necessary however. For example a further detection, in particular measurement M2, can be performed at the start of the test inlet phase TF, from which the quantity of water W' present in the wash chamber 7 at the start of the test inlet phase TF is determined. By subtracting the two detected, in particular measured, quantities, it is possible to determine the relative quantity of water W introduced during the test inlet phase TF, from which the water flow WS can then be determined as described. It should be noted here that the recirculation pump 22 could be deactivated when the detections provided, in particular measurements M1 and optionally M2, are not being performed.

In a further step the determined water flow WS is compared with a minimum water flow MWS. In FIG. 3 the determined water flow WS is below the minimum water flow MWS, from which it can be concluded that there is a malfunction of the water inlet facility 13. A message is then output by way of the output facility 4, signaling the occurrence of a malfunction of the water inlet facility to a user. The display facility here can be formed in particular for example by an optical or electrical display element, preferably an optical fiber or a light-emitting diode (LED), in or on the faucet and/or in or on the water connection line. The display element here is connected to the control facility of the dishwasher by way of an electrical or optical line. The wash cycle SG is also terminated, with the recirculation pump 22 being deactivated and the inlet valve 18 being closed. This prevents the wash cycle SG being performed with inadequate quantities of water during its individual phases. This allows an unsatisfactory washing and/or drying result to be avoided as well as damage to the dishwasher 1, for example due to a heating facility in the dishwasher 1 overheating.

The sequence of the wash cycle SG when the water inlet facility 13 is functioning correctly is now explained briefly for the purposes of comparison. The measurement M1' of the electrical power consumption P' of the recirculation pump 22 now gives a water flow WS' above the minimum water flow MWS provided during the test inlet phase TF. This indicates a fault-free water inlet facility 13, so there is no need to output a fault message. The wash cycle SG can also be continued as normal. To this end the prewash cycle VG and its filling sequence F are continued after the end of the test inlet phase. The inlet valve 18 can remain in the opened state in this process, as shown by the curve Z18'. Similarly the recirculation pump 22 can continue to operate, its power consumption P' rising as the water flow WS' is maintained.

The following method for identifying and reporting a faulty water inlet can be expedient in particular for a household dishwasher:

At the start of a program for controlling a wash cycle, it can first advantageously be ensured that there is no water or at most a small residual quantity of water present in the wash chamber of the appliance. Once this check has been performed, the inlet valve for drawing water into the dishwasher can be opened. The recirculation pump can then start. In this process the volume flow is checked within a certain time window, with the load state of the recirculation pump being detected by means of the electronic converter system of the electric motor of the recirculation pump. If a defined limit value is not reached, it can be concluded that the filling process has been faulty. This can be signaled for example with the aid of one or more LEDs in or on the faucet (faucet LED). It is also conceivable for the wash program to be terminated.

The advantages of the invention are in particular that the user can be given information that a fault is present in the water inlet facility even with appliances without impeller meters or other flow meters in the area of the water inlet facility. Said user is thus able to eliminate this problem, the cause of which may be in particular a closed faucet or a calcified corner valve, him/herself. It may not be necessary to call on the customer service department. It is also not possible to carry out a complete wash run or cycle without water.

LIST OF REFERENCE CHARACTERS

1 Dishwasher
2 Control facility
3 Operating facility
4 Output facility
5 Wash container
6 Door
7 Wash chamber
8 Housing
9 Upper rack
10 Lower rack
11 Pull-out rail
12 Pull-out rail
13 Water inlet facility
14 Connector
15 Connecting hose
16 Connector fixed to housing
17 Supply means, supply line
18 Inlet valve
19 Water inlet
20 Base of wash container
21 Collection facility, collection pan
22 Recirculation pump
23 Upper spray arm
24 Lower spray arm
25 Detection facility
26 Dosing facility
27 Drain facility
28 Drain pump, waste water pump
29 Connecting line
30 Connection fixed to housing
31 Waste water hose
32 Connector
33 Signal line
34 Signal line
35 Control line
36 Control line
37 Signal line
38 Control line
WH Water supply facility, faucet
W Water
AR Waste water disposal facility, waste water pipe
SG Wash cycle
VG Prewash cycle
F Filling phase
TF Test filling phase
ZV Predefined time value
Z18 Operating state of inlet valve
WS Water flow
MWS Minimum water flow
P Electrical power of pump
M Measurement of electrical power
Z22 Operating state of drain pump
AB Discharge phase

The invention claimed is:

1. A dishwasher, comprising:

at least one control facility for carrying out a wash cycle for cleaning items being washed;

a wash chamber to hold the items being washed during the wash cycle;

a water inlet facility connectable to an external water supply facility for filling the wash chamber with water, said water inlet facility having an inlet valve which is openable and closeable by the control facility, said control facility being configured to carry out at least one identification sequence to identify a malfunction of the water inlet facility, said identification sequence comprising a test filling phase, in which the inlet valve is opened for a period which corresponds to a predefined time value;

a recirculation pump settable by the control facility for recirculating water present in the wash chamber; and a detection facility configured to detect during operation of the recirculation pump at least one operating parameter corresponding to a quantity of water present in the wash chamber at an end of the test filling phase, wherein the control facility is configured to determine a water flow into the wash chamber during the test filling phase from the detected operating parameter and to compare the determined water flow with a minimum water flow, and wherein on condition that the control facility determines that the determined water flow is below the minimum water flow, the control facility identifies that there is a malfunction of the water inlet facility.

2. The dishwasher of claim 1, constructed in the form of a household dishwasher.

3. The dishwasher of claim 1, wherein the recirculation pump is controlled or regulated by the control facility.

4. The dishwasher of claim 1, further comprising an output facility for outputting a message which signals the identification of a malfunction to a user.

5. The dishwasher of claim 4, wherein the output facility is configured to output the message in at least one of two ways, a first way in which the message is outputted acoustically, a second way in which the message is outputted optically.

6. The dishwasher of claim 1, wherein the recirculation pump is constructed to automatically deactivate when a malfunction is identified.

7. The dishwasher of claim 1 wherein the control facility is configured to automatically execute the identification sequence during the wash cycle.

8. The dishwasher of claim 1, wherein the control facility is configured to automatically execute the identification sequence during start of the wash cycle.

9. The dishwasher of claim 1, wherein the test filling phase is integrated in a filling phase of the wash cycle to draw a predefined quantity of water.

10. The dishwasher of claim 1, wherein the control facility is configured to automatically terminate the wash cycle when a malfunction is identified.

11. The dishwasher of claim 1, further comprising a drain pump operated to provide a discharge phase before the test filling phase for discharge of water present in the wash chamber.

12. The dishwasher of claim 1, wherein the detection facility includes a sensor, and wherein, at the start of the test filling phase, the sensor carries out at least one additional detection by measuring an operating parameter of the running recirculation pump corresponding to a quantity of water present in the wash chamber.

13. The dishwasher of claim 1, wherein the at least one operating parameter represents an electrical power consumption of the recirculation pump.

14. A method for identifying a malfunction in a dishwasher having a water inlet facility which is connected to an external water supply facility for filling a wash chamber with water during a wash cycle for cleaning items being washed, said method comprising:

opening an inlet valve of the water inlet facility during a test filling phase of at least one identification sequence for a period which corresponds to a predefined time value;

detecting during operation of a recirculation pump for recirculating water in the wash chamber at least one operating parameter corresponding to a quantity of water in the wash chamber at an end of the test filling phase;

determining a water flow into the wash chamber during the test filling phase as a function of the detected operating parameter; and comparing the determined water flow with a minimum water flow, wherein on condition that a control facility determines that the determined water flow is below the minimum water flow, identifying, using the control facility, that there is a malfunction of the water inlet facility.

15. The method of claim 14, further comprising controlling or regulating operation of the recirculation pump by the control facility.

16. The method of claim 14, further comprising outputting a message which signals the identification of a malfunction to a user.

17. The method of claim 16, wherein the message is outputted in at least one of two ways, a first way in which the message is outputted acoustically, a second way in which the message is outputted optically.

18. The method of claim 14, further comprising automatically deactivating the recirculation pump when a malfunction is identified.

19. The method of claim 14, further comprising executing the identification sequence automatically during the wash cycle.

20. The method of claim 14, further comprising executing the identification sequence automatically during start of the wash cycle.

21. The method of claim 14, further comprising integrating the test filling phase in a filling phase of the wash cycle to draw a predefined quantity of water.

22. The method of claim 14, further comprising automatically terminating the wash cycle when a malfunction is identified.

23. The method of claim 14, further comprising operating a drain pump to provide a discharge phase before the test filling phase for discharge of water present in the wash chamber.

24. The method of claim 14, wherein, at the start of the test filling phase, a sensor carries out at least one additional detection by measuring an operating parameter of the running recirculation pump corresponding to a quantity of water present in the wash chamber.

25. The method of claim 14, wherein the at least one operating parameter represents an electrical power consumption of the recirculation pump.

* * * * *